US007511674B2

(12) United States Patent
McNutt

(10) Patent No.: US 7,511,674 B2
(45) **Date of Patent: *Mar. 31, 2009**

(54) SHUNT ANTENNA FOR AIRCRAFT

(75) Inventor: Duane K. McNutt, Tehachapi, CA (US)

(73) Assignee: ASB Avionics, LLC., Mohave, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/548,481

(22) Filed: Oct. 11, 2006

(65) Prior Publication Data

US 2008/0169987 A1 Jul. 17, 2008

(51) Int. Cl.
*H01Q 1/28* (2006.01)
*H01Q 13/10* (2006.01)

(52) U.S. Cl. ..... 343/705; 343/708; 343/770; 343/767

(58) Field of Classification Search ..... 343/705, 343/708, 767
See application file for complete search history.

(56) References Cited

U.S. PATENT DOCUMENTS 3,623,162 A 11/1971 Whitty et al.
4,524,840 A * 6/1985 Stuart ..... 177/210 C
5,610,620 A * 3/1997 Stites et al. ..... 343/725
5,825,332 A * 10/1998 Camacho et al. ..... 343/708
5,990,844 A 11/1999 Dumont et al.
6,097,343 A * 8/2000 Goetz et al. ..... 343/708
6,982,677 B2 1/2006 Kennety et al.
7,053,845 B1 * 5/2006 Holloway et al. ..... 343/725
7,339,537 B2 * 3/2008 Hunsberger ..... 343/705

* cited by examiner

*Primary Examiner*—Douglas W Owens
*Assistant Examiner*—Jennifer F Chang
(74) *Attorney, Agent, or Firm*—IPLA P.A.; James E. Bame

(57) ABSTRACT

A shunt antenna mountable on an aircraft comprises a lower plate, an antenna element formed above the lower plate and integrated within a dorsal fin of the aircraft where the antenna element is substantially slant relative to the lower plate; one or more couplers formed on the lower plate and operatively connected to a lower forward end of the antenna element. The couplers transmit radio frequency signals to the antenna element, and the antenna element and the lower plate are separated by air to produce a capacitor effect.

11 Claims, 4 Drawing Sheets

SHUNT ANTENNA FOR AIRCRAFT

BACKGROUND

This invention relates to an antenna for aircraft and, more particularly, to an improved shunt antenna integrated to a dorsal fin of aircraft.

Shunt antennas have been used in many places over the years. Basically the term refers to antennas, which are grounded at one end and fed low voltage and high amperage radio frequencies to cause radio frequency propagation from the other end. Shunt antennas fall into this category and they have been used on aircraft vertical tail surfaces for many years. Their use on aircraft tail surfaces causes the whole tail to radiate/receive a high frequency radio signal and results in an almost equal 360 degree propagation or ability to receive a radio frequency (RF) signal.

The entire tail surface becomes a radiator/receiver of the RF signals from the antenna. The tail surfaces of the aircraft increases the surface area of the antenna and increases the propagation or ability to receive the RF signal in all directions. Prior to the advent of shunt antennas, commercial transport aircraft were equipped with "long wire" antennas whose high-speed capabilities were unacceptable, though used, on the early jets. These antennas were designed to communicate on high frequency ("HF"). A band of frequencies in the range of 2 mhz-30 mhz designated by international treaty was used for contacts over 200 miles. 2182 kilohertz is the international distress signal.

A vertical stabilizer HF shunt antenna, which covered most of the band, was developed by Eastern Air Lines (EAL). Such design is found on several Boeing aircraft today. Its failure to cover the lower frequencies is due to its shorter length, which is limited by vertical stabilizer space considerations.

Most jets now flying internationally use vertical tail mounted HF shunt antennas, with a few installations in wing root fairings, wing tip fairings and wing leading edges. If a long wire HF antenna is used it is generally installed along the length of the fuselage. The dorsal fin HF shunt antenna as designed is installed within the dorsal structure of aircraft to be installed in place of the existing aircraft dorsal. This location maximizes the signal strength both in transmit and receive modes because it uses the adjacent aircraft vertical and horizontal stabilizers as part of the shunt antenna, and the location propagates an extremely good transmit and receive signal forward and aft of the aircraft, which other HF antenna locations do not. This is also very good for radio communications because the aircrew and most ground communications are communications pertaining to where you are going or where you have been.

The antenna coupler equipment on aircraft is mounted so that it is very close to the antenna element in the dorsal. Shunt antennas work at a lower voltage and a high amperage of 75 Amps plus. This makes long feed lines from antenna coupler to antenna counter-productive due to voltage drop and the consequent power loss. Shunt antennas mounted in the vertical stabilizer mandated mounting the tuners high in the stabilizer in inaccessible or hard to access areas to accommodate this requirement. It would be advantages to mount the tuner units where they should be very close to the feed end of the antenna.

U.S. Pat. No. 6,982,677 discloses a slot antenna with an HF carrying antenna element integrated within an additional upper plate of the slot antenna. There is a further need for a shunt antenna that reserves an improved stability, efficiency and accessibility.

SUMMARY

An objective of the shunt antenna is providing an antenna that can be retrofitted to existing Boeing aircraft in a location other than the vertical stabilizer of the aircraft, but transmitting an equal or better signal and receiving a weaker signal than existing HF antennas.

Another objective is mounting the antenna couplers in an easily accessible area. Installation costs, maintenance costs, maintenance equipment requirements and time are all significantly reduced by the improved accessibility without the requirement for tall man-lifts, that would be required if the HF antenna was installed in the vertical stabilizer. Another objective of the shunt antenna is creating an antenna structure that can be fed RF signals from the end remote from the empennage. An additional benefit is that the RF feed line can be significantly reduced in length, which minimizes interferences and improves reception and transmission efficiency.

Another objective of the shunt antenna being integrated into the existing dorsal fin of the aircraft, is that the structural integrity of the fuselage and vertical stabilizer is maintained. The removal and reinstallation of the shunt HF antenna integrated to the dorsal fin is considerably easier and less costly than the removal, modification and reinstallation of a shunt HF antenna in the existing vertical stabilizer.

Another objective is producing an economically viable alternative to the traditional long wire antenna. The benefit is a significant reduction in air drag and the associated savings in fuel costs that occur as compared to the use of a long wire antenna, some types of aircraft must use a long wire antenna to attain the lower range required for the international distress frequency of 2182 kilohertz. The new design would be advantageous for providing this capability, without the need for a long wire antenna.

Another objective of the shunt antenna is a design that can be installed without additional down time during a routine aircraft maintenance check. This significantly reduces the loss of revenue that occurs with a grounded airplane during HF Antenna installations.

To achieve these and other objectives, a shunt antenna mountable on an aircraft, comprises a lower plate; an antenna element formed above the lower plate and integrated within a dorsal fin of the aircraft, the antenna element being substantially slant relative to the lower plate; one or more couplers formed on the lower plate and operatively connected to a lower forward end of the antenna element, wherein the couplers transmit radio frequency signals to the antenna element, and wherein the antenna element and the lower plate are separated by air to produce a capacitor effect.

A feed line is provided to operatively connect the antenna couplers to the antenna element. The feed line is operatively connected to the lower forward end of the antenna element where the antenna element is integrated within a composite structure of the dorsal fin. The aerial separation of the antenna element and the lower plate serves to further produce an inductor effect. A side-by-side rack may be integrated to the lower plate to mount thereon the couplers in dual construction each connected to the feed line.

The shunt antenna is applicable to one of the Boeing Models 707, 737, 747 and C-135 derivative aircraft. Selectively, the couplers are mounted within the interior of the dorsal fin fairing. It is preferred that the feed line is about twenty four (24) inches in length.

In an embodiment, the shunt antenna mountable on an aircraft comprises: a lower plate; an antenna element formed above the lower plate and adjacent to a dorsal fin of the aircraft, the antenna element being substantially slant relative to the lower plate; one or more antenna couplers operatively connected to a lower forward end of the antenna element, wherein the antenna couplers transmit radio frequency signals to the antenna element, wherein an aft end of the antenna element is grounded to an empennage of the aircraft, wherein the antenna element and the lower plate are separated by air to produce a capacitor effect, whereby the radio frequency signals from the antenna couplers are guided towards the aft end of the antenna element and into the empennage. Here, there may be further provided a ground plate to furnish a flexible connection between the aft end of the antenna element and the aircraft vertical stabilizer, preferably in a multi-pronged shape.

Although the present invention is briefly summarized, the full understanding of the invention can be obtained by the following drawings, detailed description and appended claims.

BRIEF DESCRIPTION OF THE DRAWINGS

These and other features, aspects and advantages of the present invention will become better understood with reference to the accompanying drawings, wherein.

DETAILED DESCRIPTION OF THE PREFERRED EMBODIMENTS

Figure 1:
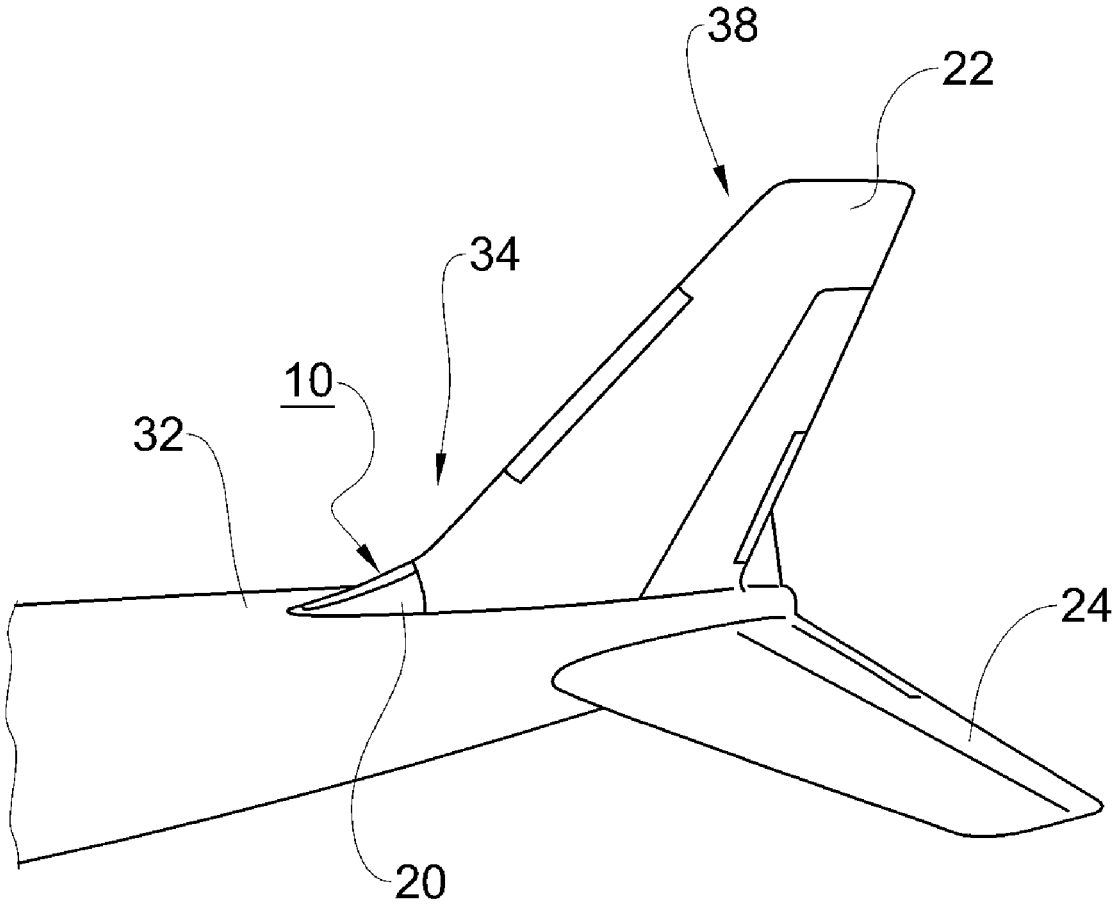
FIG. 1 is a view showing application of a shunt antenna of the present invention to an aircraft.
Figure 2:
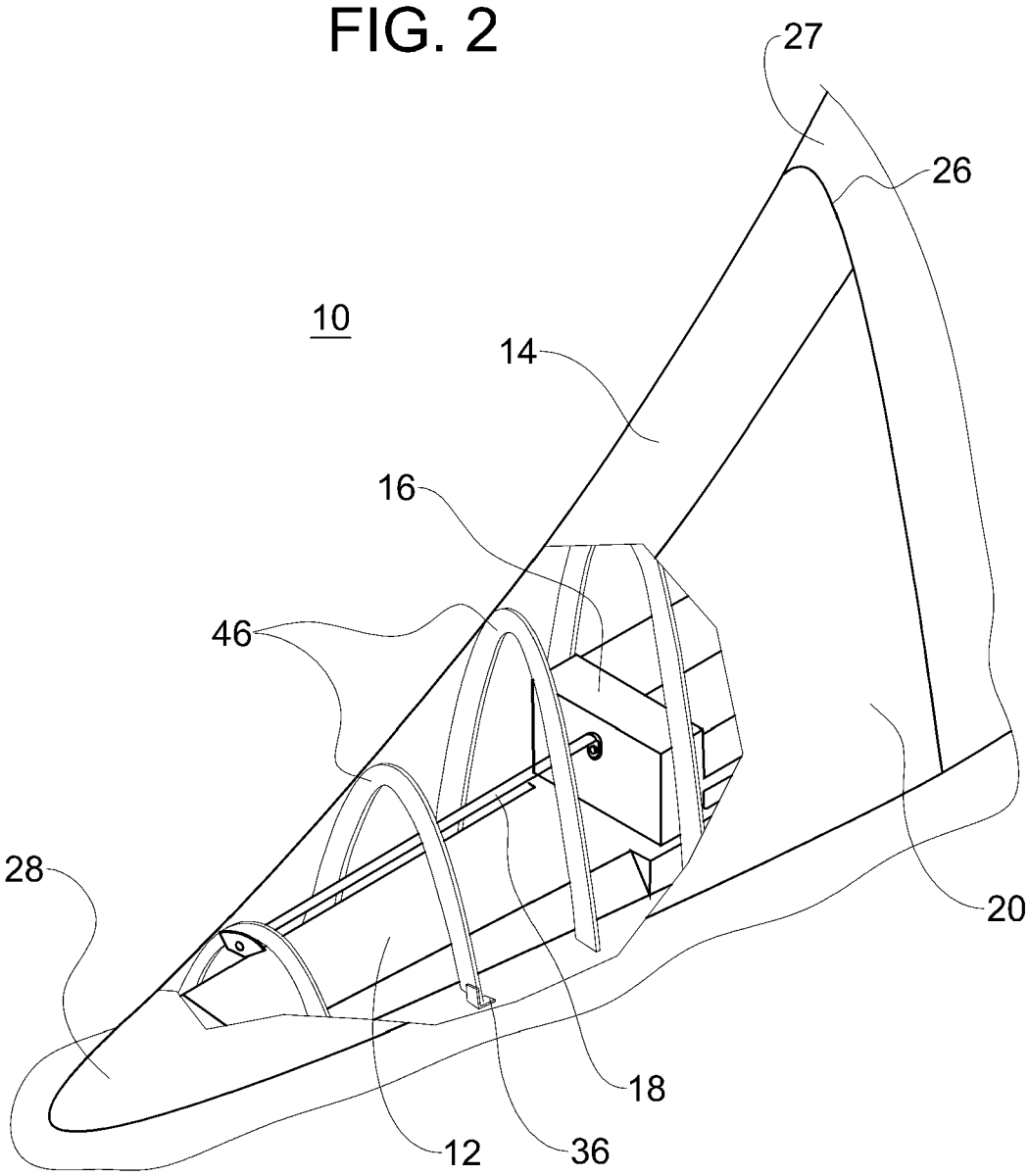
FIG. 2 is a partially cutout view of the shunt antenna.
Figure 3:
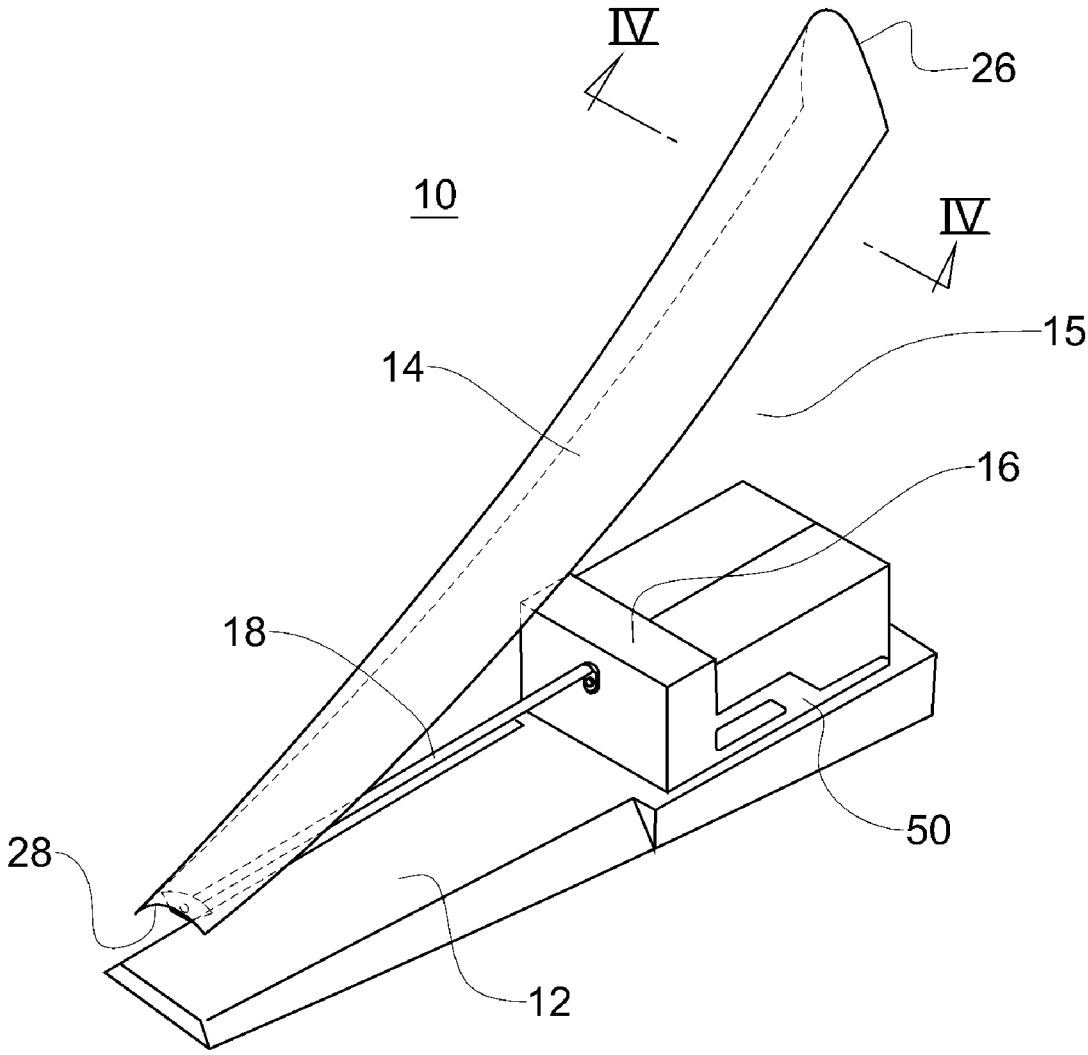
FIG. 3 is a schematic construction view of the shunt antenna.

FIG. 1 shows application of a shunt antenna 10 to an aircraft according to the present invention. FIGS. 2-3 each illustrate the shunt antenna 10 mounted in the fabricated dorsal 34 to be installed in an aircraft dorsal fin. As shown therein, the shunt antenna 10 comprises a lower plate 12 that forms a mounting shelf and RF shield, an antenna element 14, antenna couplers 16, feed line 18 connected to the antenna element 14. The antenna element 14 is integrated within the composite dorsal skin fuselage 20. The couplers 16 transmit radio frequency (RF) signals to the antenna element 14 via the feed line 18. The antenna element 14 and the lower plate 12 become charged by the RF signal substantially separated by air 15, thus the charged antenna element 14 and lower plate 12 separated by air therebetween serving as an insulator 15 produce a capacitor effect.

Figure 4:
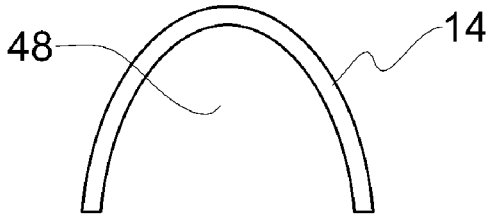
FIG. 4 is a cross-sectional view taken along line IV-IV in FIG. 3.
Figure 5:
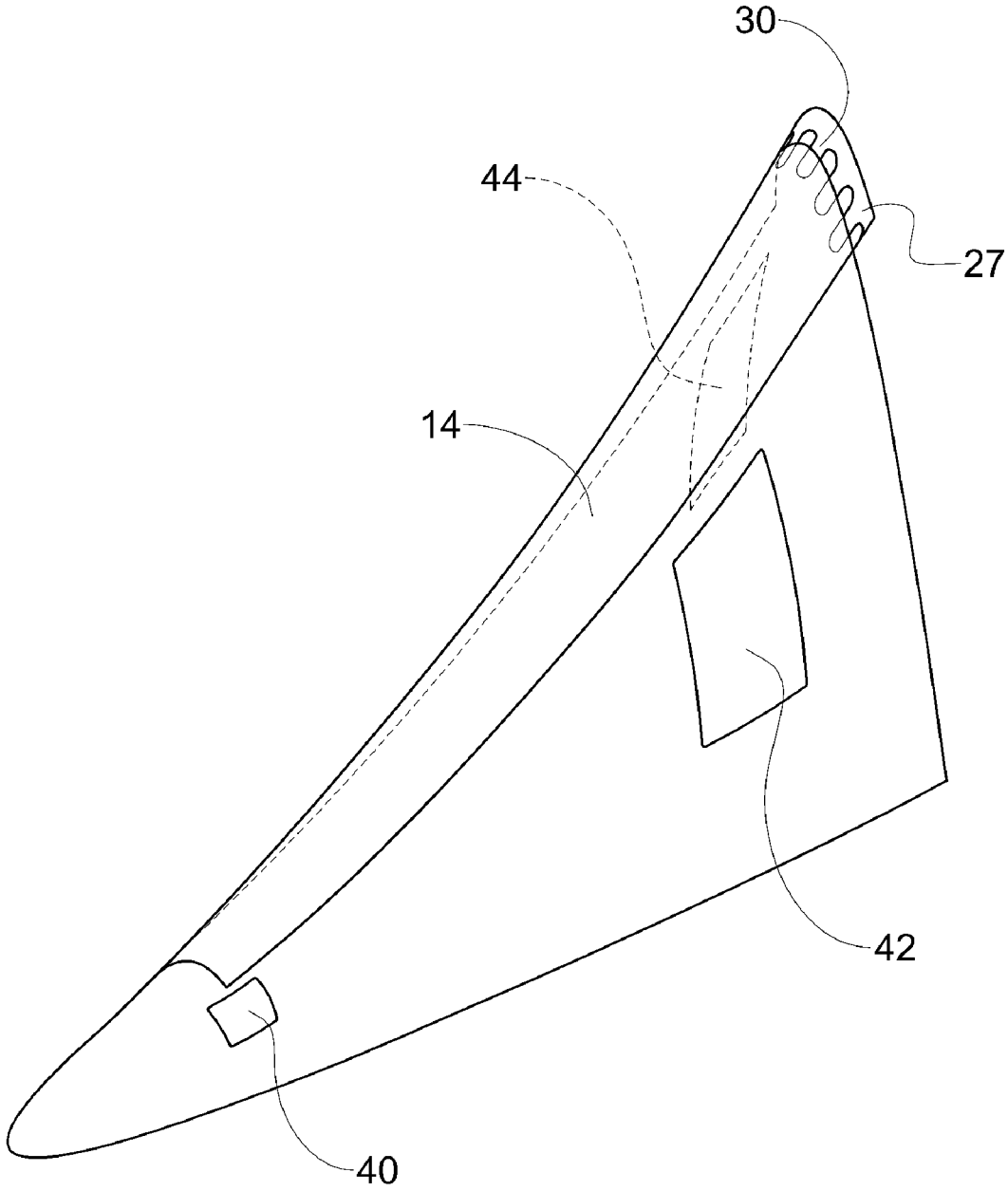
FIG. 5 is a schematic view of the shunt antenna with a finger grounding plate.

The antenna element 14 has a forward end 28 that is facing towards the nose of the aircraft and an aft end 26 that is closer to the tail of the aircraft. The tail of the aircraft forms the empennage 38, which includes the vertical stabilizer 22 and the horizontal stabilizer 24. The antenna element 14 forms the shunt cavity 48 as shown in FIG. 4. The antenna element 14 is connected at the back-end 26 thereof to the lower forward edge 27 of the existing vertical stabilizer 22 by a flexible finger grounding plate 30 as shown in FIG. 5 The antenna element 14 is substantially separated by the composite skin fuselage 20 throughout the length of the antenna element 14 and at the forward end 32 of the dorsal 34. The lower shelf 12 and the antenna couplers 16 are grounded with the aircraft through the attachment 36 of the dorsal 34 in multiple places on the top of the aircraft. Large bolts and other metallic structural components provide grounding contact between the antenna 10 and the empennage 38 incorporating the vertical and horizontal stabilizers 22, 24 to provide a path for the RF signals to travel.

The antenna element 14 is grounded at its aft end 26 near the empennage 38 with the flexible finger grounding plate 30. The antenna couplers 16 feeds energy into the forward end of the antenna element 14 through the feed line 18. The RF signal energy radiates through the antenna element 14 and towards the grounded end of the antenna element 14 through the flexible finger grounding plate 30 and into the empennage 38 at the tail of the aircraft. The vertical stabilizer 22 and the horizontal stabilizer 24 are at right angle to each other, thus they provide excellent radiation of the RF signal in both vertical and horizontal planes.

The antenna element 14 has a first width at the aft end thereof, which normally is about 13.0 inches and a second width at the forward end thereof about 6.0 inches. The antenna element 14 has a length that is typically about 68.0 inches. The length of the antenna element 14 determines the frequencies achievable. The longer the length the lower the attainable frequency will be, which provides a significant advantage. There is a relationship between the first width, the second width, the antenna element length that affects the coordinating of the antenna element 14 and lower plate 12 to function appropriately within the characteristics of the antenna couplers 16. This version provides an RF signal that will radiate a long distance. In a preferred mode, the first width is about 13.0 inches, the second width is about 6.0 inches, the antenna element length is about 68.0 inches, the length between the lower plate 12 and the lower end 28 of the antenna element 14 is about 6.0 inches, and the lower plate 12 is about 24.0 inches.

The antenna element 14 is attached to the top inside composite skin of the new dorsal fin structure that replaces the original dorsal fin. Previous designs had the antenna located within the vertical stabilizer 22 leading edge or mounted at the top of the vertical stabilizer 22 as a forward facing mast and it was believed by the industry that an antenna mounted in the dorsal fin area would not be operative.

The lower plate 12 provides mounting for the antenna couplers 16, RF protection for any existing aircraft wiring on top of the aircraft fuselage, and grounding for the antenna couplers 16 through the attach-fittings 36 at the bottom of the dorsal fairing. In this construction, the tail fin area of the aircraft with the dorsal fin area remains adjacent and in front of the tail fin.

The radio frequency feed line 18 is connected between the antenna couplers 16 and the antenna element 14. The antenna couplers 16 are mounted near the antenna element 14, (either just aft of the forward end of the antenna element or just under the forward end, depending on requirements), thus power losses are minimized.

Locating the antenna couplers 16 adjacent to the antenna element 14 is an advantage and contributes to increased transmission distances because of reduced RF losses to the antenna 10.

RF transmissions over significant distances have been achieved with this shunt antenna innovation. As further shown in FIG. 5, the composite plate 40 covers an access cutout that allows access to the feed line 18, whereas the composite plate 42 covers an access cutout that allows access to the antenna couplers 16. The composite plate 44 covers an access cutout for access to the grounding fingers plate 30 located at the aft end of the antenna element and dorsal fin fairing. These cover plates may be required in addition to any existing access plates required for general installation access.

The lower plate 12 has a top surface that is substantially flat. The lower plate 12 provides mounting for the antenna couplers 16, an RF shield for existing wiring (not shown) on top of the aircraft fuselage, and the RF ground loop for the antenna through the grounding of the lower plate via the attaching feet 36 of the dorsal fin fairing.

The antenna couplers 16 transmits radio frequency signals to the antenna element 14, which radiate towards the grounded aft-end of the antenna element 14. The aft-end of the antenna element 14 is grounded near the empennage through the finger ground plate 30 and the RF signals will radiate into the empennages 38 area. The antenna element 14 and the lower plate 12 produce a capacitor effect. The location of any parts within this cavity 48 is critical because of possible changes in tuning capabilities, by change of capacitance, throughout the complete HF frequency range.

The RF feed line 18 connects the antenna couplers 16 to the antenna element 14. The feed line 18 has a length of about 24.0 inches. The antenna couplers 16 are connected to the forward-end of the antenna element 14. There are one or more antenna couplers 16 mounted within the interior of the dorsal fin fairing. The antenna couplers 16 are mounted on a side-by-side rack 50. This arrangement allows two antenna couplers 16 to be fed directly into the same feed line 18. The interior mounting allows easy access for maintenance and replacement of the antenna couplers 16.

When required the antenna couplers 16 can be mounted inside of the aircraft. This installation may be preferred for easier access if the existing interior will allow for this type of installation.

The entire design of the shunt antenna 10 is uniquely suited for retrofitting on the dorsal fin of an aircraft. The shunt antenna 10 has many advantages including: a shorter RF feed line 18 connected to the end remote from the empennage, which improves efficiency, reduced air drag, an economically viable installation, reduced maintenance time and reduced maintenance costs.

As discussed above, the shunt antenna 10 mountable on an aircraft comprises the lower plate 12, the antenna element 14 formed above the lower plate 12 and integrated within a dorsal fin of the aircraft where the antenna element 14 is substantially slant relative to the lower plate 12. One or more couplers 16 are formed on the lower plate 12 and operatively connected to the lower forward end 28 of the antenna element 14 where the couplers 16 transmit radio frequency signals to the antenna element 14. For a better performance, the antenna element 14 and the lower plate 12 are separated by air to produce a capacitor effect. The feed line 18 serving to operatively connect the antenna couplers to the antenna element 14 is operatively connected to the lower forward end 28 of the antenna element 14. The antenna element 14 is preferably integrated within a composite structure of the dorsal fin. Here, the aerial separation of the antenna element 14 and the lower plate 12 serves to further produce an inductor effect.

A side-by-side rack 50 may be integrated to the lower plate 12 to mount thereon the couplers 16 in dual construction each connected to the feed line 18. The aircraft may be one of the Boeing Models 707, 737, 747 and C-135 derivative aircraft. Selectively, the couplers 16 may be mounted within the interior of the dorsal fin fairing. The feed line 18 is about twenty four (24) inches in length.

In an embodiment, the aft end 26 of the antenna element 14 is grounded to the empennage 38 of the aircraft so that the radio frequency signals from the antenna couplers are guided towards the aft end 26 of the antenna element 14 and into the empennage 38. In this construction, the shunt antenna 10 may further comprise a ground plate 30 to furnish a flexible connection between the aft end 26 of the antenna element 14 and the aircraft fuselage 20. It is preferred that the ground plate 30 is multi-pronged in shape as further shown in FIG. 5.

Although the present invention has been described in considerable detail with regard to the preferred versions thereof, other versions are possible. Therefore, the appended claims should not be limited to the descriptions of the preferred versions contained herein.

What is claimed is:

1. A shunt antenna mountable on an aircraft, comprising:

a lower plate;

an antenna element formed above the lower plate and adjacent to a dorsal fin of the aircraft, the antenna element being substantially slant relative to the lower plate;

one or more antenna couplers operatively connected to a lower forward end of the antenna element, wherein the antenna couplers transmit radio frequency signals to the antenna element, wherein an aft end of the antenna element is grounded to an empennage of the aircraft, wherein the antenna element and the lower plate are separated by air to produce a capacitor effect, whereby the radio frequency signals from the antenna couplers are guided towards the aft end of the antenna element and into the empennage.

2. The shunt antenna of claim 1, further comprising a feed line operatively connecting the antenna couplers to the antenna element.

3. The shunt antenna of claim 2, wherein the feed line is operatively connected to the lower forward end of the antenna element.

4. The shunt antenna of claim 1, wherein the antenna element is integrated within a composite structure of the dorsal fin.

5. The shunt antenna of claim 1, wherein the aerial separation of the antenna element and the lower plate serves to further produce an inductor effect.

6. The shunt antenna of claim 2, further comprising a side-by-side rack integrated to the lower plate to mount thereon the couplers in dual construction each connected to the feed line.

7. The shunt antenna of claim 1, wherein the aircraft is one of the Boeing Models 707, 737, 747 and C-135 derivative aircraft.

8. The shunt antenna of claim 1, wherein the couplers are mounted within the interior of the dorsal fin.

9. The shunt antenna of claim 2, wherein the feed line is about twenty four (24) inches in length.

10. The shunt antenna of claim 1, further comprising a ground plate to furnish a flexible connection between the aft end of the antenna element and the aircraft fuselage.

11. The shunt antenna of claim 10, wherein the ground plate is multi-pronged in shape.

* * * * *